US012742319B2

(12) United States Patent
Cornfield et al.

(10) Patent No.: US 12,742,319 B2
(45) Date of Patent: Sep. 22, 2026

(54) BATHTUB DRAIN CONNECTOR

(71) Applicant: Canplas Industries Ltd., Barrie (CA)

(72) Inventors: Timothy Steven Cornfield, Barrie (CA); Jack Robert Meher, Barrie (CA)

(73) Assignee: Canplas Industries Ltd., Barrie (CA)

( * ) Notice: Subject to any disclaimer, the term of this patent is extended or adjusted under 35 U.S.C. 154(b) by 106 days.

(21) Appl. No.: 18/760,142

(22) Filed: Jul. 1, 2024

(65) Prior Publication Data

US 2025/0354362 A1 Nov. 20, 2025

(30) Foreign Application Priority Data

May 15, 2024 (CA) ..... CA 3238514

(51) Int. Cl.
*E03C 1/20* (2006.01)

(52) U.S. Cl.
CPC ..... *E03C 1/20* (2013.01)

(58) Field of Classification Search
CPC .... E03C 1/20; E03C 1/22; E03C 1/232; F16L 21/02; F16L 21/022; F16L 21/025; F16L 27/0808; F16L 27/0816; F16L 27/12; E03F 5/0407; E03D 11/16
USPC ..... 285/42, 56, 58
See application file for complete search history.

(56) References Cited

U.S. PATENT DOCUMENTS 1,123,705 A * 1/1915 Dehn ..... E04D 13/0409 137/247.23
1,447,943 A 3/1923 Gerald
4,497,511 A * 2/1985 Barker ..... E03C 1/20 285/298
5,291,619 A * 3/1994 Adorjan ..... E03D 11/16 4/252.6
9,551,138 B2 1/2017 McLeod et al.
10,385,557 B2 8/2019 McLeod et al.
10,465,370 B2 * 11/2019 Donnelly ..... F16L 5/12
11,001,996 B2 5/2021 Heipp et al.
11,168,467 B2 11/2021 Xinkun
11,692,335 B2 * 7/2023 McAlpine ..... E03C 1/182 4/679
12,404,664 B2 * 9/2025 Pilarczyk ..... E03C 1/22
2022/0136226 A1 5/2022 Castellote
2023/0167633 A1 6/2023 Lorkowski et al.

FOREIGN PATENT DOCUMENTS

CA 2 813 010 C 9/2014
CA 2 919 043 C 3/2016

* cited by examiner

*Primary Examiner* — Erin Deery
(74) *Attorney, Agent, or Firm* — Hoffmann & Baron, LLP

(57) ABSTRACT

A bathtub drain connector (BDC) is for connecting a bathtub drain to a drain pipe. The BDC has a piston pipe (PP) slidably received in a body pipe (BP). The PP has an inlet for connecting to the bathtub drain. The BP has a flange for attaching to the floor, and an outlet for discharging drain water. The PP has a first seal retaining groove for retaining a first seal configured to form a watertight seal between the PP and the BP, and a second seal retaining groove between the first seal retaining groove and the PP inlet for retaining a second seal configured to form a watertight seal between the PP and the BP when the PP is shortened by removing a section thereof. A seal is retained in the first and/or second seal retaining groove. Also, a cap for closing the BP inlet, and sealing the PP inlet when pressure testing the bathtub drain connector installation.

14 Claims, 9 Drawing Sheets

BATHTUB DRAIN CONNECTOR

CROSS-REFERENCE TO RELATED APPLICATIONS

This application claims the benefit of Canadian Application No. 3,238,514, filed May 15, 2024.

FIELD OF THE INVENTION

The present invention relates generally to the field of pipe connectors for bathtubs. More particularly, the present invention relates to pipe connectors and methods for connecting freestanding bathtubs to drain pipes.

BACKGROUND OF THE INVENTION

Freestanding bathtubs are standalone, sculptural bathroom fixtures that offer a focal point of luxury and relaxation in the bathroom space, unattached to walls or surrounding surfaces. Unlike traditional built-in tubs, freestanding bathtubs are designed for flexibility in placement, allowing them to be situated anywhere in the bathroom that plumbing permits. These bathtubs come in a variety of shapes, sizes, and materials, including acrylic, stone, and metal, to fit diverse aesthetic preferences and design themes. Their distinctive appeal lies in their ability to make a bold statement, serving not only as a functional piece for bathing but also as a decorative element that enhances the overall ambiance of the bathroom. With options ranging from classic clawfoot designs to modern minimalist silhouettes, freestanding bathtubs provide a luxurious spa-like experience, elevating the bathing ritual to a serene escape.

Installing a freestanding bathtub involves several steps that are typically carried out on a finished floor surface. Initially, it necessitates the installation and positioning of water supply pipes and drain pipes beneath the surface of the floor. This process is followed by laying down a subfloor and applying the final floor covering. A plumber must be present during the initial phase to install the water supply pipes and drain pipes in the floor. The plumber will then need to return at a later construction stage, after the floor is finished, to carry out the final installation of the freestanding bathtub, and connect the freestanding bathtub to the water supply pipes and drain pipes.

There is a diverse range of freestanding bathtub models in today's market, each designed with unique dimensions and styles, which introduces challenges during installation. In particular, there is significant variability in the distance between the bottoms of such freestanding bathtubs and the floor. In the past, this variability forced plumbers to adopt a customized approach to completing these types of connections.

There have been attempts in the prior art to provide bathtub drain connectors which accommodate at least some of the variability in the distance between the bottoms of freestanding bathtubs and the floor mentioned above. The pipe connector disclosed in U.S. Pat. No. 11,447,943 (Donnelly) is an example of one such attempt. The Donnelly pipe connector has a first pipe, which is a male part that is adapted to be inserted into a second pipe, which is a female part of a slip joint. Since the first pipe has a fixed length, the range of distances between the floor and the bathtub drain that the Donnelly pipe connector can accommodate is limited by the length of the second pipe. To provide for a larger range, the second pipe must be made longer to be able to receive a longer first pipe. A problem with the Donnelly pipe connector is that the maximum length of the second pipe is dictated by the thickness of the floors in which the pipe connector is intended to be installed, since the second pipe has to fit into the floor and connect to the drain pipe. This constraint is all the more significant when one considers that having a shorter second pipe would be preferable because it would allow the Donnelly pipe connector to be accommodated by more floors.

Considering the extended period between the installation of the bathtub drain pipe in the floor and the completion of its connection to the bathtub during construction, it is common practice to use a dust cap. Dust caps help prevent dust from entering the bathtub drain pipe throughout the construction process.

It is also known to provide a separate pressure test cap for performing a hydrostatic pressure test to check for leaks in the plumbing with the newly connected bathtub drain pipe.

Some examples of prior art pipe connectors and caps include those disclosed in: U.S. Pat. Nos. 9,551,138; 10,385,557; and U.S. Pat. Nos. 11,168,467; and 11,001,996; U.S. Patent Application Publication Nos. 2023-0167633; and 2022-0136226; and Canadian Patent Nos. 2,813,010; and 2,919,043.

However, there remains a need for improvements in the field of bathtub drain connectors.

SUMMARY OF THE INVENTION

What is desired therefore, is a bathtub drain connector which overcomes at least some of the problems associated with the prior art, and which is cost efficient and economical to manufacture.

In one embodiment of the present invention, there is provided a bathtub drain connector for connecting a bathtub drain to a drain pipe in a floor. The bathtub drain connector has a piston pipe that is slidably received in a body pipe. The piston pipe has an inlet for connecting to the bathtub drain. The body pipe has a flange for attaching the bathtub drain connector to the floor, and an outlet for discharging drain water into the drain pipe. Preferably, a seal may be mounted on an exterior surface of the piston pipe to form a watertight seal between the piston pipe and the body pipe. Preferably, the bathtub drain connector may be further provided with a cap. The preferred cap includes a body pipe engagement feature for attaching the cap to the body pipe inlet to close the body pipe inlet, and a piston pipe engagement feature for simultaneously attaching the cap to the piston pipe inlet to seal the piston pipe inlet during a plumbing leakage pressure test of the bathtub drain connector when installed to the drain pipe.

In another embodiment of the present invention, there is provided a bathtub drain connector for connecting a bathtub drain to a drain pipe in a floor. The bathtub drain connector has a piston pipe that is slidably received in a body pipe. The piston pipe has an inlet for connecting to the bathtub drain. The body pipe has a flange for attaching the bathtub drain connector to the floor, and an outlet for discharging drain water into the drain pipe. Preferably, the piston pipe has a first seal retaining groove on an exterior surface thereof for retaining a first seal (i.e. an O-ring type seal made of rubber or a rubber-like material), configured to form a watertight seal between the piston pipe and the body pipe, and a second seal retaining groove on the exterior surface thereof between the first seal retaining groove and the piston pipe inlet for retaining a seal configured to form a watertight seal between the piston pipe and the body pipe when the piston pipe is shortened by removing a section thereof that includes the first seal retaining groove and excludes the second seal retaining groove. Preferably, a seal may be retained in the first and/or second seal retaining groove.

Therefore, according to one aspect of the present invention, there is disclosed a bathtub drain connector for connecting a bathtub drain to a drain pipe in a floor, the bathtub drain connector comprising:

a piston pipe having an inlet, an outlet, and a passageway therebetween, the piston pipe further comprising a bathtub drain engagement feature associated with the piston pipe inlet for connecting the bathtub drain to the piston pipe to allow water from the bathtub drain to pass through the piston pipe inlet into the piston pipe passageway and drain out of the piston pipe through the piston pipe outlet;

a body pipe having an inlet, an outlet, and a passageway therebetween, the body pipe further comprising a flange for attaching the body pipe to the floor, and the body pipe inlet being configured to allow at least a portion of the piston pipe including the piston pipe outlet to pass through to be slidably received in the body pipe passageway and selectively positioned within the body pipe passageway such that the water draining from the piston pipe outlet enters the body pipe passageway and drains out of the body pipe through the body pipe outlet;

a seal forming a watertight seal between the piston pipe and a wall of the body pipe passageway; and a cap including a body pipe engagement feature for attaching the cap to the body pipe inlet to close the body pipe inlet, and a piston pipe engagement feature for simultaneously attaching the cap to the piston pipe inlet to seal the piston pipe inlet during a plumbing leakage pressure test of the bathtub drain connector when installed to the drain pipe.

Advantageously, the seal may be mounted on an exterior surface of the piston pipe to form the watertight seal between the piston pipe and the wall of the body pipe passageway.

According to another aspect of the present invention, there is disclosed a bathtub drain connector for connecting a bathtub drain to a drain pipe in a floor, the bathtub drain connector comprising:

a piston pipe having an inlet, an outlet, and a passageway therebetween, the piston pipe further comprising a bathtub drain engagement feature associated with the piston pipe inlet for connecting the bathtub drain to the piston pipe to allow water from the bathtub drain to pass through the piston pipe inlet into the piston pipe passageway and drain out of the piston pipe through the piston pipe outlet;

a body pipe having an inlet, an outlet, and a passageway therebetween, the body pipe further comprising a flange for attaching the body pipe to the floor, and the body pipe inlet being configured to allow at least a portion of the piston pipe including the piston pipe outlet to pass therethrough to be slidably received in the body pipe passageway and selectively positioned within the body pipe passageway such that water draining from the piston pipe outlet enters the body pipe passageway and drains out of the body pipe through the body pipe outlet;

a first seal retaining groove on an exterior surface of the piston pipe for retaining a seal configured to form a watertight seal between the piston pipe and the body pipe when the piston pipe is received in the body pipe passageway; and a second seal retaining groove on the exterior surface of the piston pipe between the first seal retaining groove and the piston pipe inlet for retaining the seal, or another seal configured to form a watertight seal between the piston pipe and the body pipe when the piston pipe is shortened by removing a section thereof that includes the first seal retaining groove and excludes the second seal retaining groove.

Advantageously, the bathtub drain connector may further comprise the seal retained in one of the first seal retaining groove and the second seal retaining groove.

According to yet another aspect of the present invention there is disclosed a method of connecting a bathtub drain to a drain pipe in a floor, the method comprising the steps of:

providing a body pipe having an inlet, an outlet, a passageway therebetween, and a flange for attaching the body pipe to the floor;

connecting the body pipe outlet to the drain pipe in the floor and attaching the flange to the floor;

providing a piston pipe having an inlet, an outlet, and a passageway therebetween, the piston pipe further comprising a first seal retaining groove on an exterior surface of the piston pipe for retaining a seal configured to form a watertight seal between the piston pipe and the body pipe when the piston pipe is received in the body pipe passageway, and a second seal retaining groove on the exterior surface of the piston pipe between the first seal retaining groove and the piston pipe inlet for retaining the seal, or another seal configured to form a watertight seal between the piston pipe and the body pipe when the piston pipe is shortened by removing a section thereof that includes the first seal retaining groove and excludes the second seal retaining groove;

cutting the piston pipe between the first seal retaining groove and the second seal retaining groove to remove the section thereof that includes the first seal retaining groove;

mounting the seal, or the another seal in the second seal retaining groove of the shortened piston pipe;

inserting at least a portion of the shortened piston pipe including the second seal retaining groove through the body pipe inlet to be slidably received in the body pipe passageway;

selectively positioning the shortened piston pipe within the body pipe passageway to set the piston pipe inlet at a desired height above the floor; and connecting the bathtub drain to the piston pipe inlet to allow water from the bathtub drain to pass through the piston pipe and the body pipe into the drain pipe.

BRIEF DESCRIPTION OF THE DRAWINGS

Reference will now be made to the preferred embodiments of the present invention with reference, by way of example only, to the following drawings in which.

DETAILED DESCRIPTION OF THE PREFERRED EMBODIMENTS

The present invention is described in more detail with reference to exemplary embodiments thereof as shown in the appended drawings. While the present invention is described below including preferred embodiments, it should be understood that the present invention is not limited thereto. In the figures, like elements are given like reference numbers. For the purposes of clarity, not every component is labelled in every figure, nor is every component of each embodiment of the invention shown where illustration is not necessary to allow persons skilled in the art to understand the invention. Orientative words such as, for example, "vertical", "top", "bottom", "front", "rear", and "side" as used herein are used for clarity with reference to the orientation of elements in the figures and are not intended to be limiting.

Figure 1:
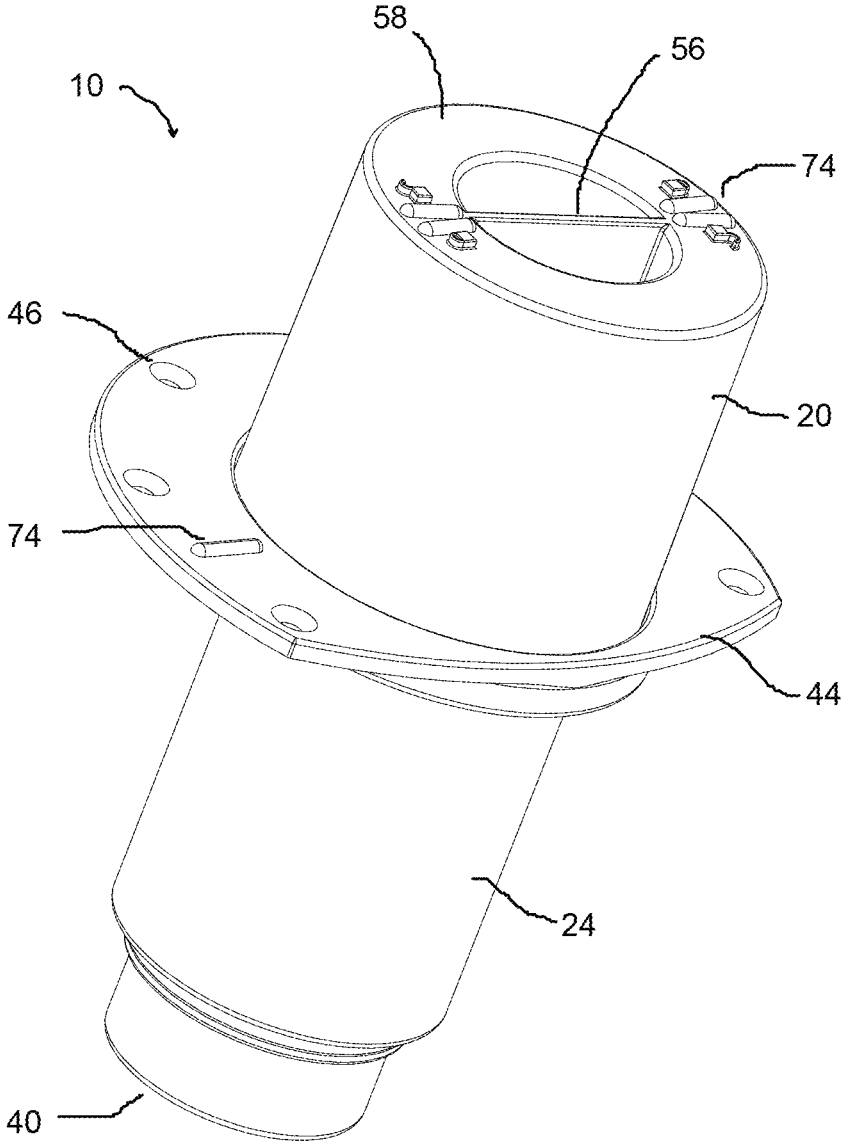
FIG. 1 is a perspective view of a bathtub drain connector and cap according to an embodiment of the present invention.
Figure 23:
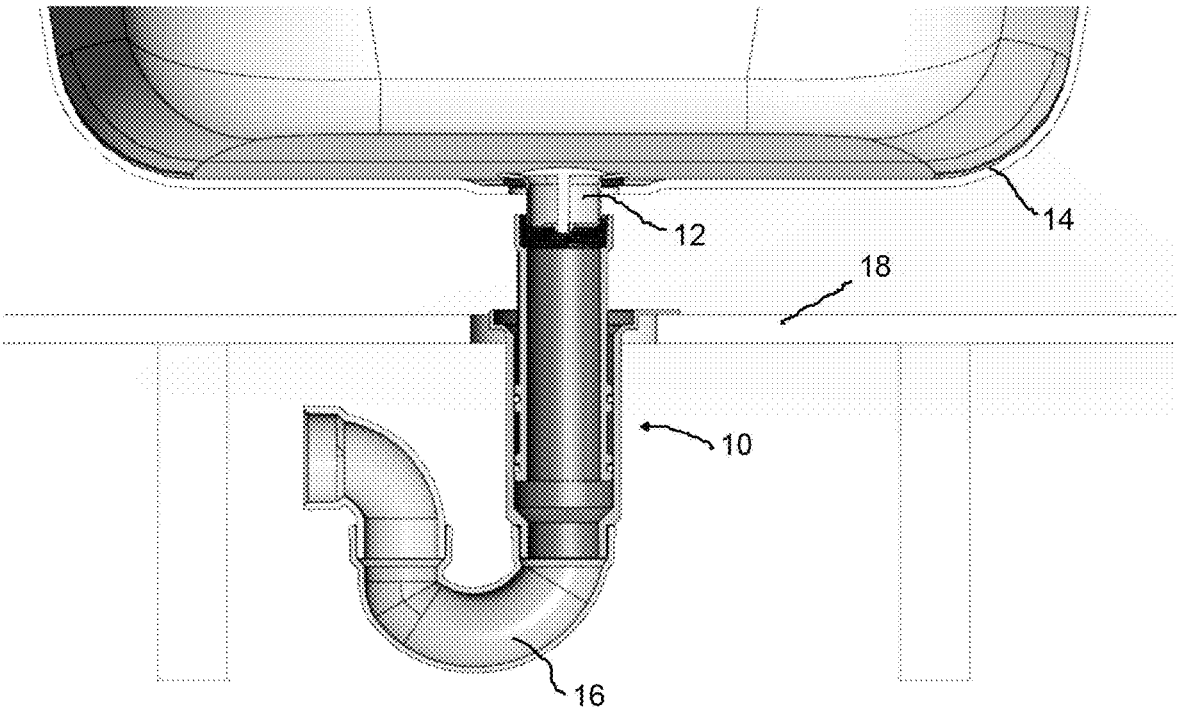
FIG. 23 is a cross-sectional view of the bathtub drain connector of FIG. 3 installed to connect a bathtub drain to a drain pipe in a floor.

FIG. 1 shows a bathtub drain connector 10 according to an embodiment of the present invention. The bathtub drain connector 10 is configured for connecting a bathtub drain 12 of a bathtub 14 to a drain pipe 16, such as a P-trap for example, in a floor 18, as shown in FIG. 23.

The bathtub drain connector 10 preferably may include a cap 20. As will be described in more detail later, the cap 20 may simultaneously serve as both a dust cap, and a pressure test cap. As a dust cap, the cap 20 is configured to prevent dust and construction debris from entering the bathtub drain connector 10 and contaminating the drain pipe 16. As a pressure test cap, the cap 20 is configured to allow the user to perform a hydrostatic pressure test to check for leaks after the bathtub drain connector 10 is installed in the floor 18 and connected to the drain pipe 16, but before the bathtub drain connector 10 is connected to the bathtub drain 12 of the bathtub 14.

Figure 2:
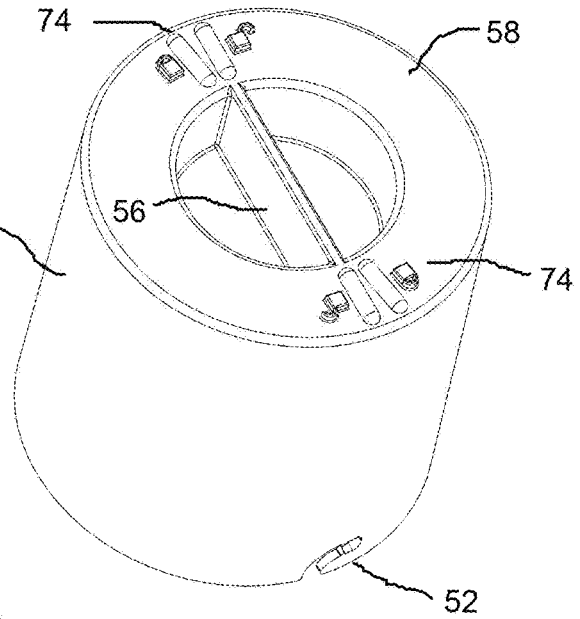
FIG. 2 is a perspective view of the cap of FIG. 2.
Figure 3:
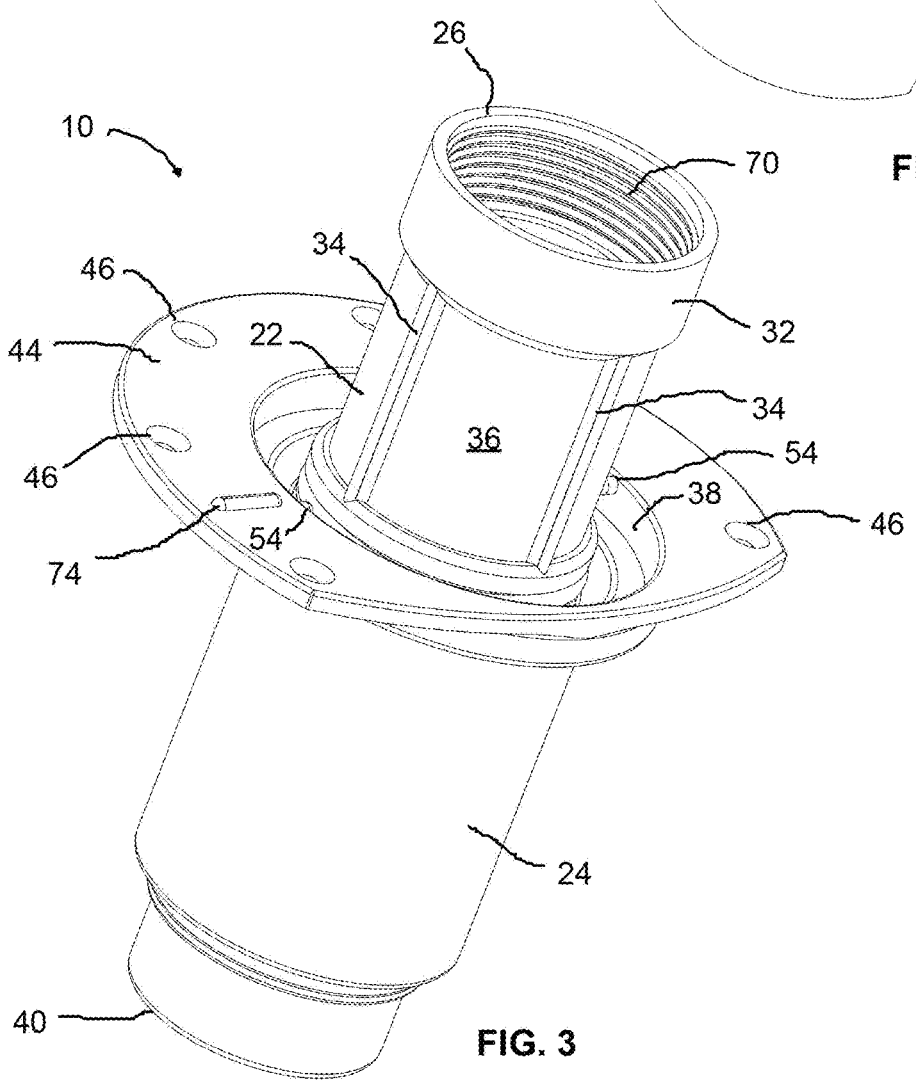
FIG. 3 is a perspective top view of FIG. 1 with the cap removed to show a piston pipe of the bathtub drain connector slidably received in a body pipe of the bathtub drain connector.
Figure 4:
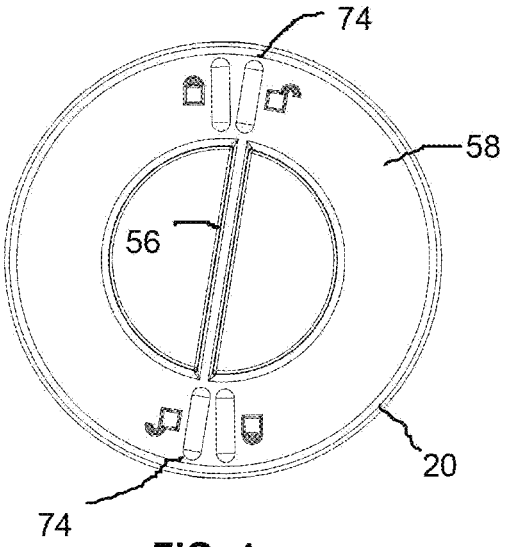
FIG. 4 is a top view of the cap of FIG. 2.
Figure 19:
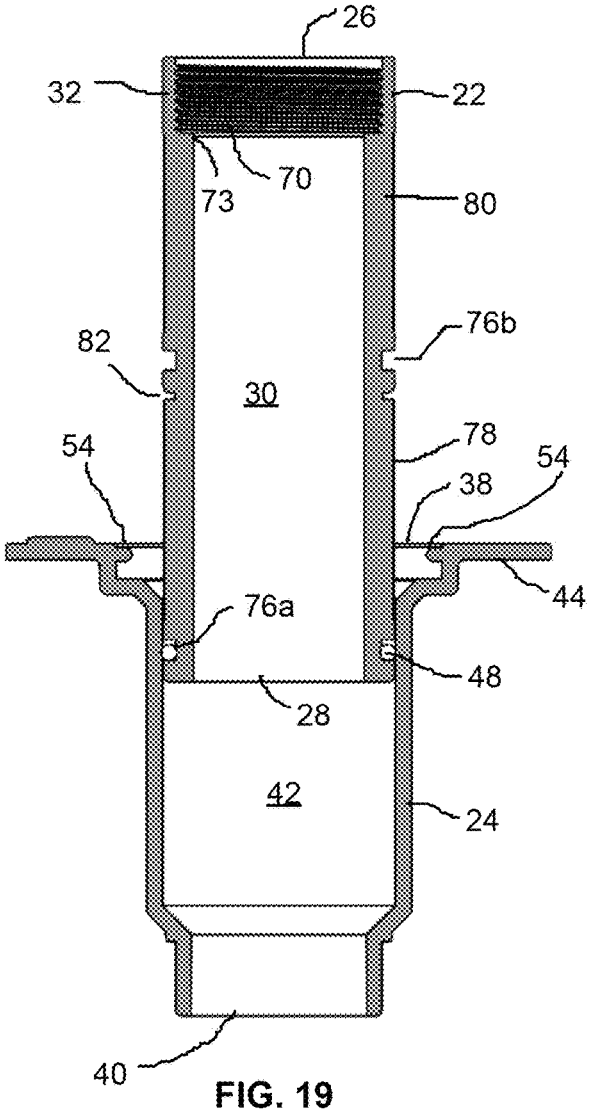
FIG. 19 is a cross-sectional view of the bathtub drain connector of FIG. 18.

Referring now to FIGS. 2 and 3, removing the cap 20 from the bathtub drain connector 10 reveals a piston pipe 22 slidably received in a body pipe 24. The piston pipe 22 is a substantially cylindrical, elongate, tubular member. Preferably, the piston pipe 22 may be made from injection molded plastic. The piston pipe 22 has an inlet 26, an outlet 28, and a passageway 30 therebetween (as best seen in FIG. 19). The piston pipe 22 preferably also includes a bathtub drain engagement feature 32 associated with the piston pipe inlet 26 for connecting the bathtub drain 12 to the piston pipe 22 to allow water from the bathtub 14 to drain out the bathtub drain 12 and pass through the piston pipe inlet 26 into the piston pipe passageway 30 and drain out of the piston pipe 22 through the piston pipe outlet 28. The piston pipe 22 may also include one or more reinforcing ribs 34 positioned longitudinally on its exterior surface 36. The one or more reinforcing ribs 34 may be used to improve the overall strength and/or rigidity of the piston pipe 22, in a known manner, without increasing its weight or material cost.

The body pipe 24 has an inlet 38, an outlet 40, and a passageway 42 therebetween. Like the piston pipe 22, the body pipe 24 is also a substantially cylindrical, elongate, tubular member. Preferably, the body pipe 24 may be made from injection molded plastic. Preferably, the body pipe 24 may also include a flange 44 for attaching the body pipe 24 to the floor 18. As such, the flange 44 may be provided with one or more apertures 46 configured for use with one or more fasteners (not shown), in a known manner.

Figure 9:
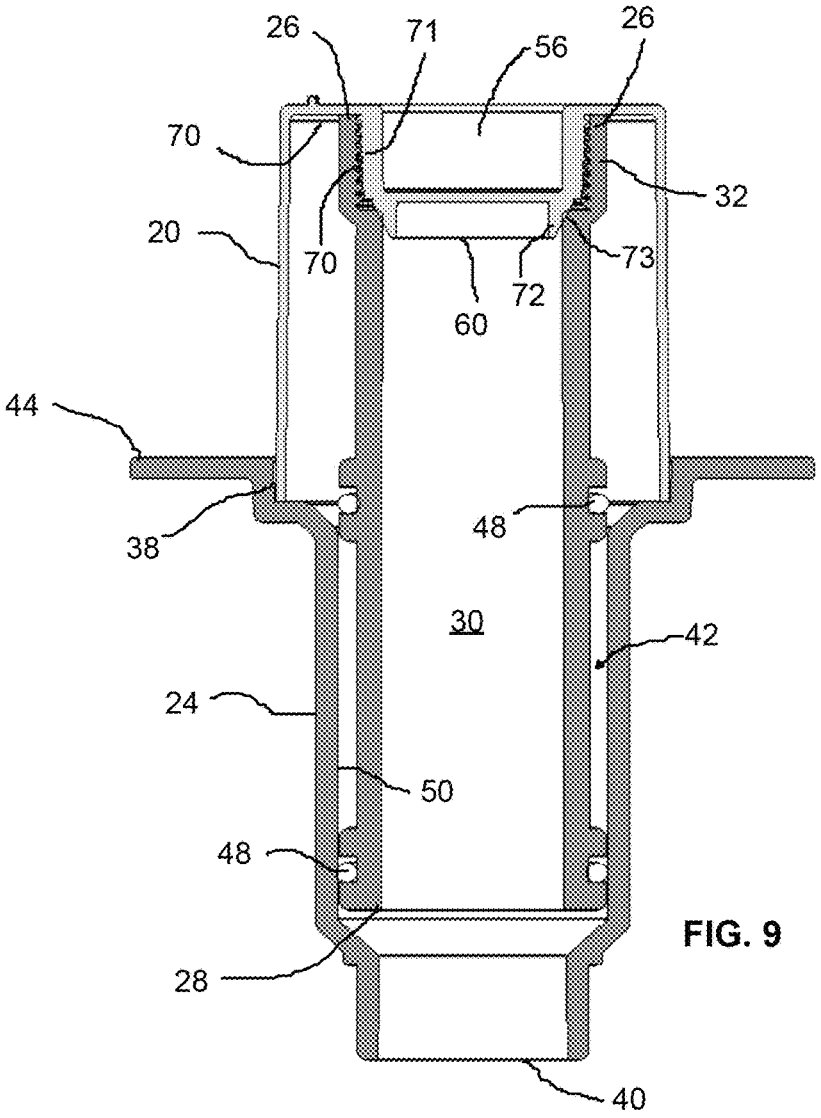
FIG. 9 is a cross-sectional view of the bathtub drain connector and cap of FIG. 1.
Figure 10:
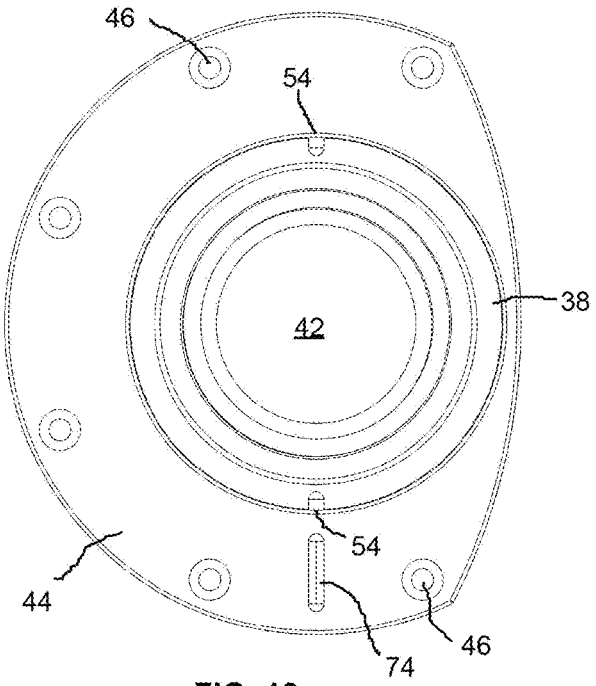
FIG. 10 is a top view of the body pipe of FIG. 3.
Figure 11:
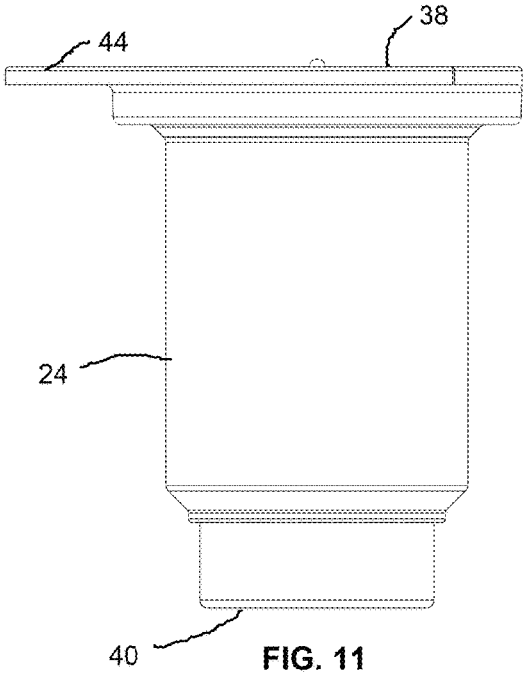
FIG. 11 is a side view of the body pipe of FIG. 3.
Figure 12:
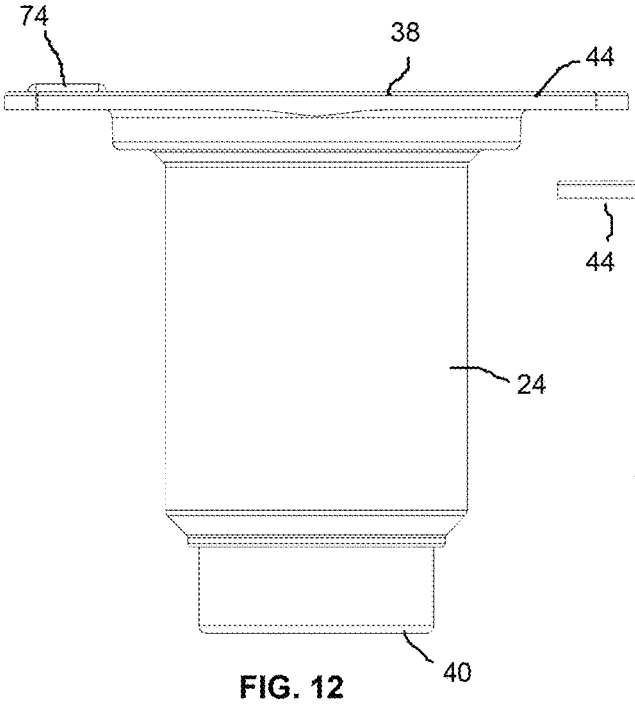
FIG. 12 is a front view of the body pipe of FIG. 3.
Figure 13:
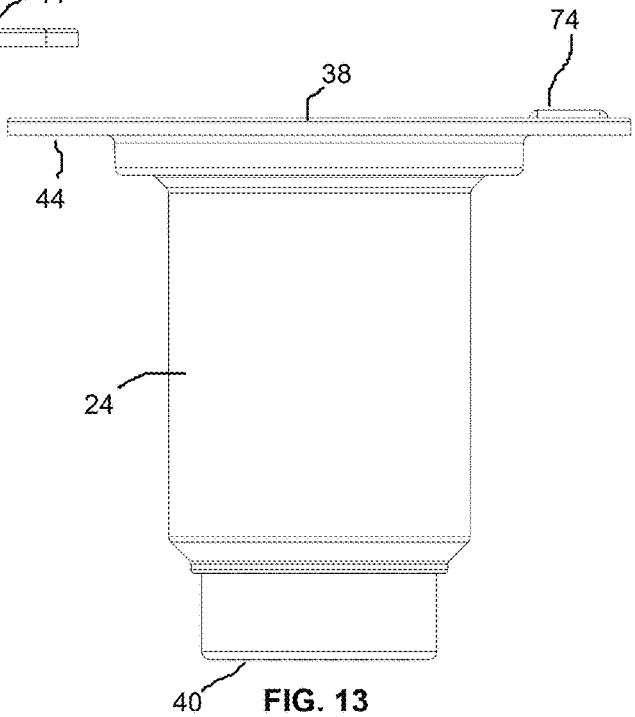
FIG. 13 is a rear view of the body pipe of FIG. 3.
Figure 14:
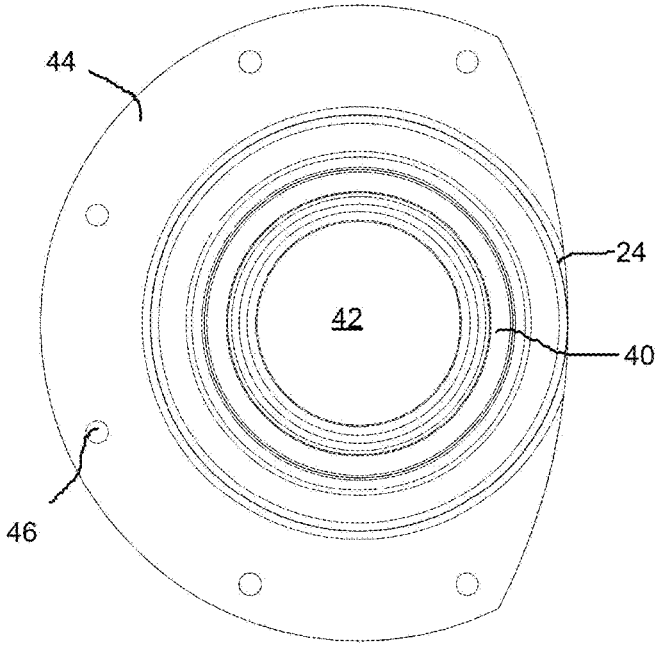
FIG. 14 is a bottom view of the body pipe of FIG. 3.

With reference to FIGS. 3 and 9, it can be seen that the body pipe inlet 38 is configured to allow at least a portion of the piston pipe 22, including the piston pipe outlet 28 to pass through to be slidably received in the body pipe passageway 42, such that the water draining from the piston pipe outlet 28 enters the body pipe passageway 42 and drains out of the body pipe 24 through the body pipe outlet 40. The piston pipe 22 may be selectively positioned within the body pipe passageway 42 with its outlet 28 in any position within the body pipe passageway 42 that a seal between the piston pipe 22 and the body pipe 24 can be assured. In this way, sliding the piston pipe 22 as far into the body pipe passageway 42 as it will go, without breaking the seal between the piston pie 22 and the body pipe 24, will leave the shortest length of the piston pipe 22 extending out from the body pipe 24. Conversely, sliding the piston pipe 22 as far as it will go outwardly from the body pipe 24, without breaking the seal between the piston pipe 22 and the body pipe 24, will leave the largest length of the piston pipe 22 extending out from the body pipe 24.

Referring now to FIG. 9, at least one seal 48 is mounted on the exterior surface 36 of the piston pipe 22 to form the watertight seal between the piston pipe 22 and the body pipe 24, as mentioned above. Preferably, the seal may be made from an elastomeric material, capable of forming the watertight seal between the piston pipe 22 and a wall 50 of the body pipe passageway 42. As an example, the seal may be an O-ring type seal made of rubber, or a rubber-like material.

In the example shown in FIG. 9, two seals 48 are shown mounted on the exterior surface 36 of the piston pipe 22. However, depending on the application, more than two seals 48 may be used, although a minimum of one seal will most likely be required. All such embodiments are comprehended by the present invention.

Referring back to FIGS. 2 and 3, the cap 20 may preferably include a body pipe engagement feature 52 for attaching the cap 20 to the body pipe inlet 38 to close the body pipe inlet 38. The body pipe 24 has a complementary engageable feature 54 that is engageable by the body pipe engagement feature 52. In this example, the body pipe engagement feature 52 on the cap 20 is a bayonet connector, and complementary engageable feature 54 on the body pipe 24 is a male pin projecting into the body pipe inlet 38.

Preferably, the body pipe inlet 38 may include a complementary engageable feature 54 configured to be engaged by the body pipe engagement feature 52. In this example, the complementary engageable feature 54 takes the form of at least one male pin, and the body pipe engagement feature 52 takes the form of at least one female slot, for mating with the at least one male pin thereby forming a bayonet connection attaching the cap 20 to the body pipe 24. It will be appreciated that more than one of each male pin and female slot may be used depending on the application. However, good results have been obtained with two male pins and two female slots configured so that one of the two female slots mates with one of the two male pins, and the other one of the two female slots mates with the other one of the two male pins. Moreover, it will be appreciated that the locations of the male pins and female pins may be reversed, such that the male pins are provided on the cap 20, and the female slots are provided in the body pipe inlet 38. Other combinations are also possible. All such embodiments are comprehended by the present invention. What is important is that when incorporated into the cap 20 of the bathtub drain connector 10, the body pipe engagement feature 52 is configured to form a mechanical connection with the body pipe 24 to releasably lock the cap 20 to the body pipe 24.

Most preferably, the mechanical connection is formed by rotating the cap in one direction, which in this example is a clock-wise direction. A finger grip or handle 56 may be provided in the top 58 of cap 20 to allow the user to grip and rotate the cap 20 with his fingers.

Figure 8:
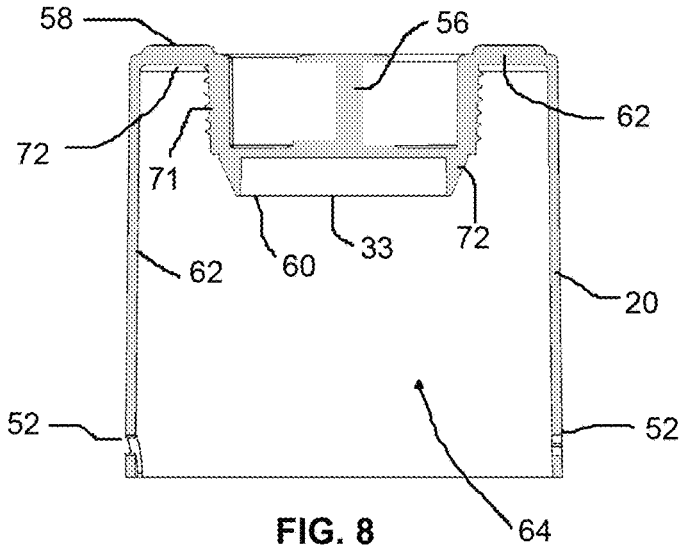
FIG. 8 is a cross-sectional view of the cap of FIG. 2.

Referring to FIGS. 8 and 9, the cap 20 may preferably also include a piston pipe engagement feature 33 for attaching the cap 20 to the piston pipe inlet 26, for example to seal the piston pipe inlet 26 during a plumbing leakage pressure test of the bathtub drain connector 10 when installed to the drain pipe 16. Thus, the piston pipe engagement feature 33 may be configured to engage with the bathtub drain engagement feature 32 to attach the cap 20 to the piston pipe inlet 38. By way of example, the bathtub drain engagement feature 32 may be provided with threading 70 on an interior surface of the piston pipe 22 and the piston pipe engagement feature 33 may be provided with corresponding cap threading 71 to attach the cap 20 to the piston pipe 22 by rotating the cap 20 relative to the piston pipe 22.

With continued reference to FIG. 8, the piston pipe engagement feature 33 may preferably take the form of a projection 60 projecting from the interior wall 62 of the cap 20 into the interior space 64 defined by the cap interior wall 62. Furthermore, the handle 56 mentioned above may preferably be incorporated into the projection 60.

With reference to FIG. 1, the cap 20 and the body pipe 24 preferably may include visual or textual marks 74 which align to indicate that a) the cap 20 is attached to the body pipe 24 with the body pipe engagement feature 52, or b) that the cap 20 is not attached to the body pipe 24 with the body pipe engagement feature 52. By way of example only, the markings may be printed, engraved, or molded, lines, symbols, words, pictures, or combinations thereof. In this example, the markings include lines, and representations of a pad lock in open and closed configurations, projecting from the surfaces of the top 58 of the cap 20, and the flange 44 of the body pipe 24. Person's skilled in the art will be appreciated that numerous other markings 74 may be used with the same effectiveness. All such embodiments are comprehended by the present invention.

Figure 5:
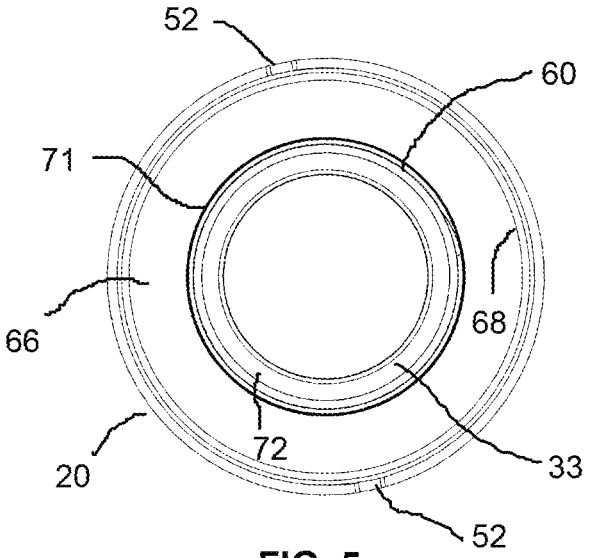
FIG. 5 is a bottom view of the cap of FIG. 2.
Figure 6:
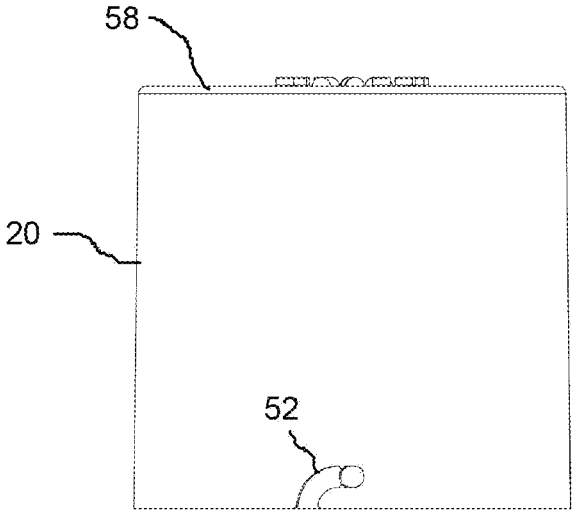
FIG. 6 is a side view of the cap of FIG. 2.
Figure 7:
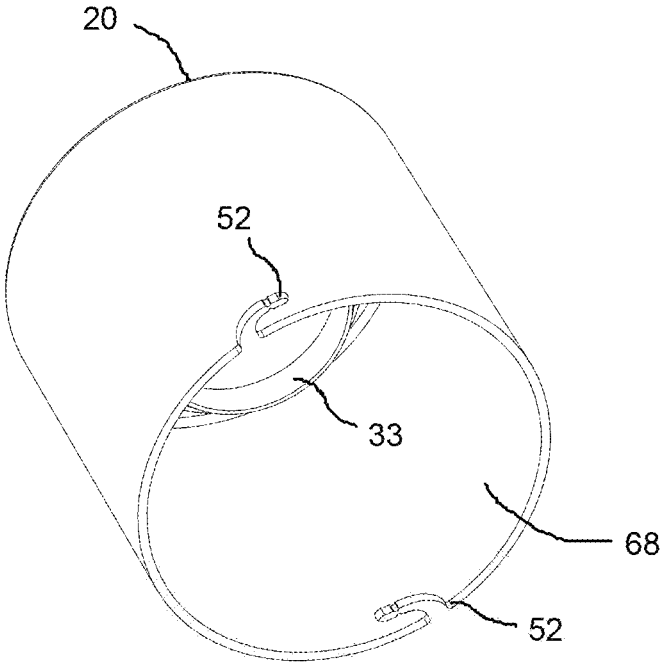
FIG. 7 is a perspective bottom view of the cap of FIG. 2.

As best seen in FIG. 5, the cap interior wall 62 includes an end wall 66, and a side wall, and the projection 60 is mounted to the end wall 66. Preferably, the cap 20, including the projection 60 and the cap interior wall 62, may be composed of injection molded plastic. Most preferably, the projection 60 may be co-molded with the cap interior wall 62.

As best seen in FIG. 8, the projection 60 preferably includes cap threading 71 positioned thereon, and the cap 20 further includes an annular surface 72 positioned about the projection 60. Preferably, the annular surface 72 is configured such that when the cap 20 is screwed onto the piston pipe 22, the annular surface 72 impinges on a complementary surface 73 positioned on the interior of the bathtub drain engagement feature 32 of the piston pipe 22. This configuration creates an interference condition to provide a watertight seal that is adequate for performing a hydrostatic pressure test. The projection 60 is sized and the cap threading 71 is configured to be threaded into the bathtub drain engagement feature 32 of the piston pipe 22, allowing the cap 20 to be attached to the piston pipe inlet 26, as best seen in FIG. 9. In this regard, the bathtub drain engagement feature 32 comprises threading 70 on an interior surface of the piston pipe 22 at the piston pipe inlet 26, and the projection 60 comprises corresponding cap threading 71 to attach the cap 20 to the piston pipe 22 by rotating the cap 20 relative to the piston pipe 22.

In this way, the cap 20 may be simultaneously attached to the piston pipe inlet 26 by the threaded projection 60, and to the body pipe inlet 38 by the body pipe engagement feature 52. This is particularly useful for packaging and transporting the bathtub drain connector 10 to customers, as all the main components of the bathtub drain connector 10, namely the cap 20, the piston pipe 22, and the body pipe 24, are held together. However, it has been found that being able to simultaneously attach the cap 20 to the piston pipe inlet 26 and the body pipe inlet 38 is also useful for keeping construction dust and debris out of the drain pipe 16 during the period between the initial installation of the bathtub drain connector 10 in the floor 18 and final connection to the bathtub drain 12 of the freestanding bathtub 14.

Most preferably, the cap 20 may also include the annular surface 72, as mentioned above, which is adapted to form a watertight seal between the piston pipe 22 and the cap 20. Ensuring that a watertight seal is formed is important for conducting a plumbing leakage pressure test of the bathtub drain connector 10 when installed to the drain pipe 16. Advantageously, providing the cap 20 with the body pipe engagement feature 52, and using it to releasably lock the cap 20 to the body pipe 24, will help retain the piston pipe 22 in the body pipe 24, preventing the piston pipe 22 from blowing out of the body pipe 24 during the plumbing leakage pressure test.

Figure 15:
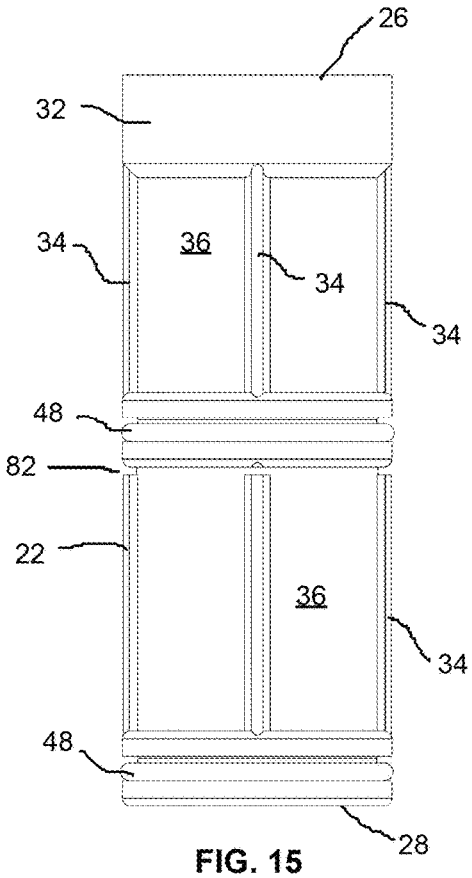
FIG. 15 is a side view of the piston pipe of FIG. 3.
Figure 16:
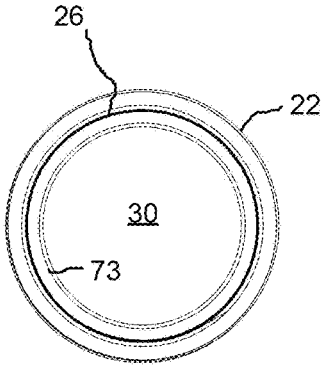
FIG. 16 is a top view of the piston pipe of FIG. 3.
Figure 17:
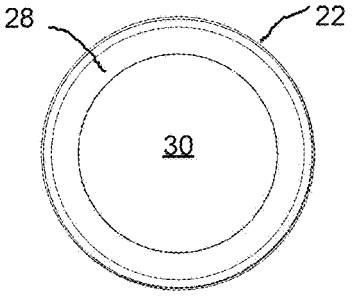
FIG. 17 is a bottom view of the piston pipe of FIG. 3.
Figure 18:
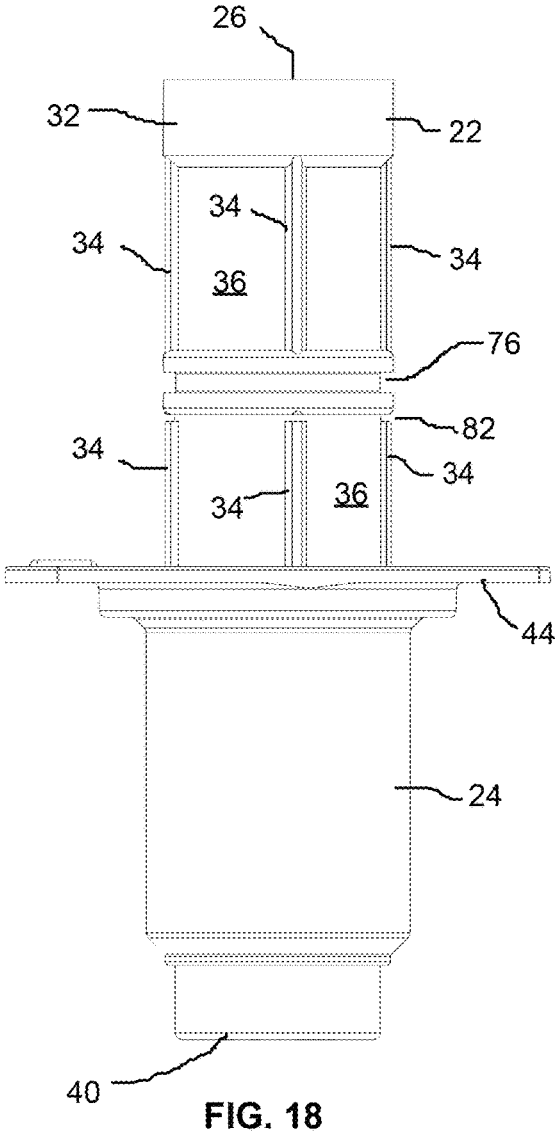
FIG. 18 is a side view of the bathtub drain connector of FIG. 3, with the piston pipe selectively positioned in the body pipe to set the piston pipe inlet at a maximum height above the floor, according to an embodiment of the present invention.

Referring now to FIGS. 18 and 19, the piston pipe 22 preferably may include at least one seal retaining groove 76 on the exterior surface 36 configured to retain a seal 48. If more than one seal retaining groove 76 is provided on the piston pipe 22, as is the case in the example shown in FIGS. 18 and 19, a seal 48 will preferably also be mounted on the piston pipe 22 so as to be retained by the bottommost seal retaining groove 76 (i.e. the seal retaining groove located closest to the piston pipe outlet 28), as shown. In this way, at least the seal 48 retained by the bottommost seal retaining groove will provide the requisite watertight seal between the piston pipe 22 and the body pipe 24. However, it is contemplated that additional seals 48 may be mounted on the piston pipe 22, retained in the one or more additional seal retaining grooves 76 that may be provided on the piston pipe 22, for example as shown in FIGS. 15 and 23. Depending on the application, there is no limit to the number of seal retaining grooves 76 or seals 48 that can feasibly be provided on the external surface 36 of a piston pipe 22. Additionally, it will be understood that the piston pipe 22 may be provided with fewer seals 48 than there are seal retaining grooves 76 capable of retaining seals 48, with the expectation that a user may remove one or more of the seals 48 from their respective seal retaining grooves 76, and reposition them to be retained by one or more vacant seal retaining grooves 76, as desired. All such embodiments are comprehended by the present invention.

Advantageously, the bathtub drain connector 10 may be provided with a length adjustable piston pipe 22, to increase the range of freestanding bathtub models that the bathtub drain connector 10 can be used with. An embodiment of such a bathtub drain connector 10 is described next with reference to FIGS. 18-22.

Starting with FIGS. 18 and 19, there is shown a bathtub drain connector 10 with a piston pipe 22 and body pipe 24, as described above. The piston pipe 22 has an inlet 26, an outlet 28, and a passageway therebetween 30. The piston pipe 22 also has a bathtub drain engagement feature 32 associated with the piston pipe inlet 24 for connecting the bathtub drain 12 to the piston pipe 22 to allow water from the bathtub drain 12 to pass through the piston pipe inlet 26 into the piston pipe passageway 30 and drain out of the piston pipe 22 through the piston pipe outlet 28. The body pipe 24 has an inlet 38, an outlet 40, and a passageway 42 therebetween. The body pipe 24 also has a flange 44 for attaching the body pipe 24 to the floor 18, and the body pipe inlet 38 is configured to allow at least a portion of the piston pipe 22 including the piston pipe outlet 28 to pass therethrough to be slidably received in the body pipe passageway 42 and selectively positioned within the body pipe passageway 42 such that water draining from the piston pipe outlet 28 enters the body pipe passageway 42 and drains out of the body pipe 24 through the body pipe outlet 40. The body pipe outlet 40 may preferably be configured for attachment to the drain pipe 16 in a known manner, to complete the pathway for the water from the bathtub 14 all the way through to the drain pipe 16, and subsequently to the sanitary plumbing network.

As best seen in FIG. 19, the piston pipe 22 may be provided with two seal retaining grooves 76, differentiated in the following description as first seal retaining groove 76*a* and second seal retaining groove 76*b*. In this example, the first seal retaining groove 76*a* is on an exterior surface 36 of the piston pipe 22 for retaining a seal 48 configured to form a watertight seal between the piston pipe 22 and the body pipe 24 when the piston pipe 22 is received in the body pipe passageway 42, and a second seal retaining groove 76*b* is on the exterior surface 36 of the piston pipe 22 between the first seal retaining groove 76*a* and the piston pipe inlet 26 for retaining the seal 48, or another seal configured to form a watertight seal between the piston pipe 22 and the body pipe 24, when the piston pipe 22 is shortened by removing a section 78 thereof that includes the first seal retaining groove 76*a* and excludes the second seal retaining groove 76*b*, leaving behind a shortened section 80 of piston pipe 22. Preferably, the first and second seal retaining grooves 76*a*, 76*b* may be positioned between 5.5 centimetres and 7.5 centimetres apart.

As discussed above, the seal 48 retained in the first seal retaining groove 76*a*, and if present, the other seal retained in the second seal retaining groove 76*b* may preferably be O-rings, which are readily available and relatively inexpensive. Preferably, a seal 48 will be retained in at least one of the first seal retaining groove 76*a* and the second seal retaining groove 76*b*. Most preferably, if one seal 48 is provided, it will be mounted in the first seal retaining groove 76*a*. However, it is permissible for a seal 48 to be retained in both of the first and second seal retaining grooves 76*a*, 76*b*, in other embodiments. It will be understood that if only one seal 48 is provided, the user will be able to move it from the first seal retaining groove 76*a* to the second seal retaining groove 76*b*, and vice versa, as needed. All such embodiments are comprehended by the present invention.

Figure 20:
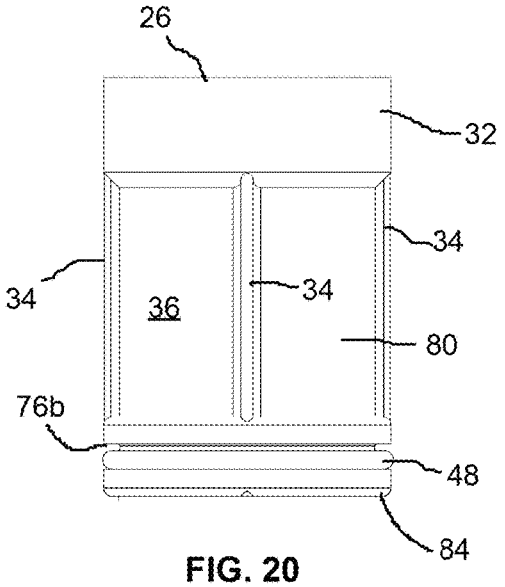
FIG. 20 is a side view of a shortened piston pipe according to an embodiment of the present invention.

It will now be understood that the length of the piston pipe 22 may be adjusted by cutting the piston pipe 22 between the first seal retaining groove 76*a*, and the second seal retaining groove 76*b*. Most preferably, the user may cut the piston pipe 22 near the second seal retaining groove 76*b*, resulting in a section 78 being removed from the piston pipe 22, to form a shortened piston pipe 80, as shown in FIG. 20. After the cut is made, the user may move the seal 48 from the first seal retaining groove 76*a* to the second seal retaining groove 76*b* on the shortened piston pipe 80, if a seal 48 is missing from the second seal retaining groove 76*b*. Furthermore, the piston pipe 22 may be provided with more than one removable section 78 to give the user even more options for adjusting the length of the piston pipe 22.

To facilitate shortening of the piston pipe 22, a transverse line of weakness 82 may be provided on the piston pipe 22 between the first seal retaining groove 76*a* and the second seal retaining groove 76*b*. By way of example, the transverse line of weakness 82 may be an area of reduced material requiring less effort by the user to saw or cut the piston pipe 22. Preferably, the transverse line of weakness 82 may be configured to catch and guide a knife or saw blade being used by the user to cut the piston pipe 22. Most preferably, the transverse line of weakness 82 may be configured to form a beveled edge 84, as best seen in FIG. 20, when sawed or cut by the user. Advantageously, configuring the traverse line of weakness 82 to provide a beveled edge 84 when cut makes it easier for the user to insert the shortened piston pipe 80 into the body pipe 24 after completing the length adjustment.

However, it is contemplated that the provision of the transverse line of weakness 82 is optional, and may be omitted altogether. Alternately, the transverse line of weakness 82 may be substituted with one or more markings adapted to guide the user when cutting the piston pipe 22 to prepare the shortened piston pipe 80. For example, the one or more markings may comprise one or more transverse visible lines, whether printed, painted, etched, engraved, embossed, or achieved through any other similar or yet to be developed method, on the exterior surface 36 of the piston pipe 22. The one or more markings may include a line printed about the circumference of the piston pipe 22. As a further example, the one or more markings may also include one or more symbols printed on the exterior surface 36 of the piston pipe 22.

Figure 22:
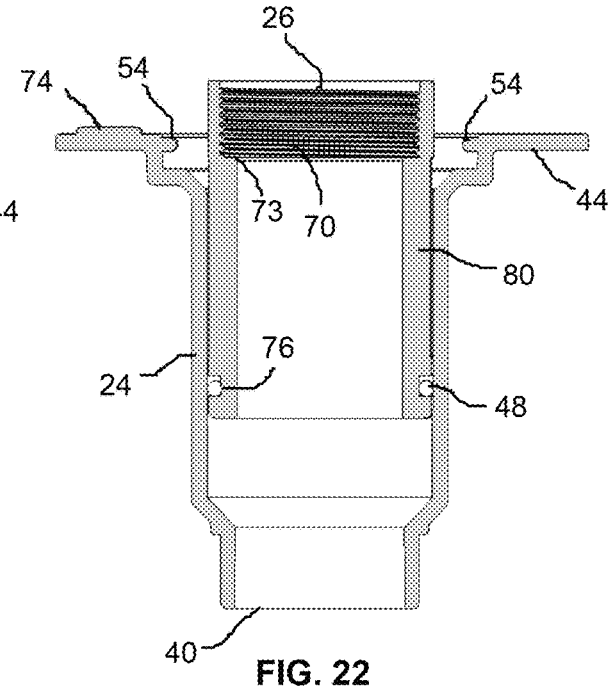
FIG. 22 is a cross-sectional view of the bathtub drain connector of FIG. 21.

Referring now to FIG. 22, after completing the length adjustment, the bathtub drain connector 10 featuring the shortened piston pipe 80 is ready for installation. The inlet 26 of the shortened piston pipe 80 includes the bathtub drain engagement feature 32 from the original (pre-cut) piston pipe 22. Accordingly, the bathtub drain engagement feature 32 of the shortened piston pipe 80 has threading on the interior surface of the piston pipe inlet 26, the same as the original (pre-cut) piston pipe 22, for engaging complementary threading on the bathtub drain 12.

In situations where the bathtub drain 12 does not include threading, an adaptor may be attached to the bathtub drain 12 with, for example, an adhesive. Such an adapter will preferably have adaptor threading suitable for engaging the piston pipe threading.

Having described embodiments of the bathtub drain connector 10, a method of connecting a bathtub drain 12 to a drain pipe 16 in a floor 18 will be described next.

Preferably, the user may obtain a bathtub drain connector 10, for example as shown in FIG. 1, with the cap 20 threaded into the bathtub drain engagement feature 32 associated with the inlet 26 of the piston pipe 22, and attached to the body pipe 24 by the bayonet connection formed between the body pipe engagement feature 52 of the cap 20, and the complementary engageable feature 54 of the body pipe 24. In this way, the cap 20 holds all of the components of the bathtub drain connector 10 together, which is useful for packaging and transporting the bathtub drain connector 10 in a compact form. Advantageously, with the piston pipe 22 held in the body pipe 24 by the cap 20, there is less chance for the piston pipe 22 to be misplaced and become lost during construction.

Referring now to FIG. 23, the user may then locate the drain pipe 16 installed in the floor 18, positioned such that its inlet aligns with the anticipated location of the bathtub drain 12 of the freestanding bathtub 14 being installed at that site. Then the user may connect the bathtub drain connector 10 to the inlet of the drain pipe 16 in a known manner. For example, the user may apply adhesive (i.e. PVC solvent cement) to both the outlet 40 of the body pipe 24 and the inlet of the drain pipe 16, and then insert the body pipe outlet 40 into the drain pipe 16 to form a permanent watertight joint. The user may also secure the bathtub drain connector 10 to the floor 18 by its flange 44 using fasteners, such as screws (not shown). Additionally, the user may use poured concrete to further secure the bathtub drain connector 10 to the floor 18.

At this point, the bathtub drain connector 10 is partially installed, connected to the sanitary plumbing network by the drain pipe 16, and attached to the floor 18, with the cap 20 locked in place to protect against construction dust and debris entering the drain pipe 16. Furthermore, with the cap 20 attached to the piston pipe 22, and locked in place on the body pipe 24, the user may conduct a plumbing leakage pressure test if it is desired. With the bathtub drain connector 10 partially installed, construction may continue in the site, including finishing of the floor 18.

After the floor 18 is finished it will be time to bring in the freestanding bathtub 14 and move it in position to connect to the bathtub drain connector 10. But prior to moving the freestanding bathtub 14 in position over the bathtub drain connector 10, the cap 20 and piston pipe 22 should be removed from the body pipe 24. For example, the user may turn the cap 20 in a clockwise direction (or a counterclockwise direction in other embodiments), to unlock and detach the cap 20 from the body pipe 24. The user may use the handle 56 provided in the top 58 of the cap 20 to grip and rotate the cap 20 with his or her fingers. And the user will continue to turn the cap 20 in the same direction to completely unscrew, and remove the cap 20 from the piston pipe 22, as depicted with FIGS. 2 and 3 on page 2/9 of the drawings. With the cap 20 detached, the user can grab a hold of the exposed end of the piston pipe 22 and pull it out from the body pipe 24.

Now the user can move the freestanding bathtub 14 above the bathtub drain connector 10 with its bathtub drain 12 aligned overtop the uncovered body pipe inlet 38. The user then measures the distance between the top of body pipe inlet 38 and the bathtub drain 12 to determine whether the piston pipe 22 needs to be shortened to facilitate the connection to the bathtub drain 12.

If it is determined that the piston pipe 22 does not need to be shortened, then with the freestanding bathtub 14 moved out of the way, the piston pipe 22 may be inserted all the way back into the body pipe 24. Then the user may move the freestanding bathtub 14 back into position, extend the piston pipe 22 outwardly from the body pipe 24 to reach the bathtub drain 12 of the freestanding bathtub 14, and threadingly engage the bathtub drain engagement feature 32 of the piston pipe 22 to the bathtub drain 12 with complementary threads, to complete the installation of the bathtub drain connector 10.

By way of further example, the bathtub drain connector 10 may be connected to the bathtub drain 12 of the freestanding bathtub 14 according to the following method instead. The user may detach the piston pipe 22 from the body pipe 24 and connect it to the bathtub drain 12. Then the attached piston pipe 22 can be slid into the body pipe inlet 38 of the body pipe 24 as the freestanding bathtub 14 is lowered into place. At this point, it will become apparent whether or not the piston pipe 22 will need to be shortened. If the piston pipe 22 bottoms out in the body pipe 24, preventing the freestanding bathtub 14 from being lowering completely to rest on the floor 18, the piston pipe 22 will need to be shortened, in which case a measurement should be taken to determine the required length to be removed from the piston pipe 22.

It is also contemplated that the bathtub drain connector 10 may be provided to users with a set of installation instructions. The installation instructions may preferably describe a method for determining whether or not the piston pipe 22 will need to be shortened based on the drain-to-floor height clearance of the freestanding bathtub 14, avoiding the need for the user to make the above noted measurements. It is also contemplated that the piston pipe 22 may be connected to the bathtub drain 12 using adapters that may require solvent cement to complete a watertight joint. All such embodiments are comprehended by the present invention.

Finally, the user may connect water supply pipes (not shown) to the freestanding bathtub 14 in a known manner to complete the installation of the freestanding bathtub 14.

If, as discussed above, the user determines that the piston pipe 22 does need to be shortened, because it is too long for the spacing between the bathtub drain 12 and the floor 18, then the piston pipe 22 will need to be cut to an appropriate shortened length before being inserted back into the body pipe 24.

To facilitate cutting the piston pipe 22, there may be provided one or more transverse lines of weakness 82 along the length of the piston pipe 22 to allow the user to more easily cut the piston pipe 22 at one or more locations, to produce a shortened piston pipe 80 in one or more shortened lengths. Thus, if only one transverse line of weakness 82 is provided, then cutting the piston pipe 22 at that transverse line of weakness 82 will only produce a shortened piston pipe 80 with one length. However, if two transverse lines of weakness 82 are provided, then the user is able to choose between two possible shortened lengths for the shortened piston pipe 80 depending on which of the transverse lines of weaknesses 82 are chosen for the cut. That said, whether or not there are transverse lines of weakness 82 present on the piston pipe 22, does not limit whether or where the user may cut the piston pipe 22 to prepare the shortened piston pipe 80. If no transverse lines of weakness 82 are present, the user may still cut the piston pipe 22 to produce the shortened piston pipe 80. Furthermore, even if a transverse line of weakness 82 is present on the piston pipe 22, the user may choose to cut the piston pipe 22 at a different location, away from the transverse line of weakness 82. What is important is that a seal 48 is mounted on the piston pipe 22 between the location of the transverse cut, and the inlet 26 of the piston pipe 22, so that the shortened piston pipe 80 will be able to seal to the body pipe 24 when the shortened piston pipe 80 is inserted into the body pipe 24.

As shown in FIGS. 18 and 19, the piston pipe 22 has a first seal retaining groove 76*a* on an exterior surface 36 of the piston pipe 22 for retaining a seal 48 configured to form a watertight seal between the piston pipe 22 and the body pipe 24 when the piston pipe 22 is received in the body pipe passageway 42. A second seal retaining groove 76*b* is provided on the exterior surface 36 of the piston pipe 22 between the first seal retaining groove 76*a* and the piston pipe inlet 26. The second seal retaining groove 76*b* is also configured for retaining a seal 48 configured to form a watertight seal between the piston pipe 22 and the body pipe 24.

Accordingly, to shorten the piston pipe 22 to the appropriate shortened length the user will cut the piston pipe 22 and remove the section 78 thereof that includes the first seal retaining groove 76*a* and excludes the second seal retaining groove 76*b*. In this example, a seal 48 is not provided in the second seal retaining groove 76*b*, but that does not mean that a seal 48 can not be provided in the second seal retaining groove 76*b* in other embodiments; it can be. However, it is more cost efficient to provide one seal 48, mounting it in the first seal retaining groove 76*a*, and having the user move the seal 48 from the first seal retaining groove 76*a* to the second seal retaining groove 76*b* after cutting away the section 78 of the piston pipe 22 containing the first seal retaining groove 76*a*. Either way, the user will end up producing the shortened piston pipe 80, for example as shown in FIG. 20.

Figure 21:
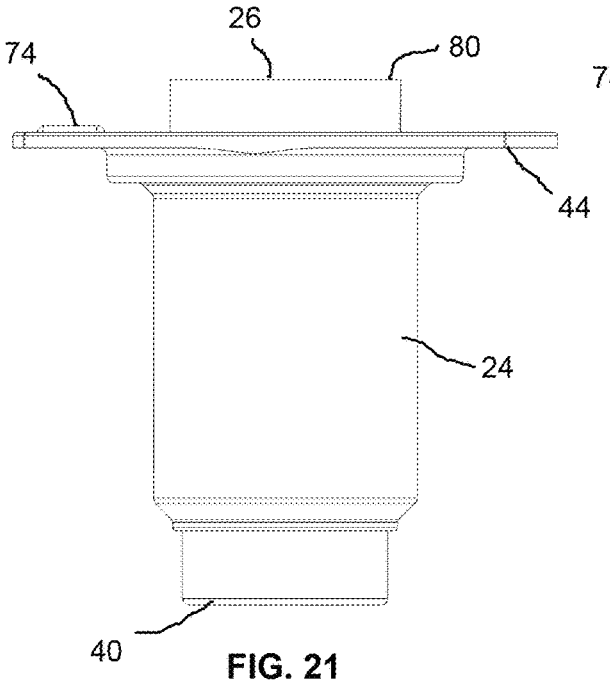
FIG. 21 is a side view of a bathtub drain connector with the shortened piston pipe of FIG. 20 selectively positioned in the body pipe to set the piston pipe inlet at a minimum heigh above the floor, according to an embodiment of the present invention.

Referring now to FIGS. 21 and 22, with the freestanding bathtub 14 moved out of the way, the user may then insert the shortened piston pipe 80 into the body pipe 24, through the body pipe inlet 38, so that at least a portion of the shortened piston pipe 80 including the seal 48 retained in the second seal retaining groove 76*b* is slidably received in the body pipe passageway 42. In fact, the user may insert the shortened piston pipe 80 all the way into the body pipe 24 so that it will not be in the way when moving the freestanding bathtub 14 back into position.

Alternately, the shortened piston 22 may be connected to the bathtub drain 12, and slid into the body pipe 24, as the freestanding bathtub 14 is moved into position.

At that point, the user may move the freestanding bathtub 14 back into position, extend the shortened piston pipe 80 outwardly from the body pipe 24 to reach the bathtub drain 12 of the freestanding bathtub 14, and threadingly engage the bathtub drain engagement feature 32 of the shortened piston pipe 80 to the bathtub drain 12 with complementary threads, to complete the installation of the bathtub drain connector 10. That said, it is contemplated that according to other embodiments the engagement of the bathtub drain engagement feature 32 of the shortened piston pipe 80 to the bathtub drain 12 may be achieved using threaded adapters and solvent cement.

Finally, the user may connect water supply pipes (not shown) to the freestanding bathtub 14 in a known manner to complete the installation of the freestanding bathtub 14.

While reference has been made to various preferred embodiments of the invention, other variations, implementations, modifications, alterations and embodiments are comprehended by the broad scope of the appended claims. Some of these have been discussed in detail in this specification and others will be apparent to those skilled in the art. For example, the piston pipe 22 may be provided with three or any number more of the seal retaining grooves, defining two or more selectively removable sections 78, to provide the user with two or more piston pipe 22 shortening options. Similarly, the piston pipe 22 may be provided with two or any number more of the transverse lines of weakness to provide the user with two or more guided piston pipe 22 shortening options. Those of ordinary skill in the art having access to the teachings herein will recognize these additional variations, implementations, modifications, alterations and embodiments, all of which are within the scope of the present invention, which invention is limited only by the appended claims.

We claim:

1. A bathtub drain connector for connecting a bathtub drain to a drain pipe in a floor, the bathtub drain connector comprising:

a piston pipe having an inlet, an outlet, and a passageway therebetween, the piston pipe further comprising a bathtub drain engagement feature associated with the piston pipe inlet for connecting the bathtub drain to the piston pipe to allow water from the bathtub drain to pass through the piston pipe inlet into the piston pipe passageway and drain out of the piston pipe through the piston pipe outlet;

a body pipe having an inlet, an outlet, and a passageway therebetween, the body pipe further comprising a flange for attaching the body pipe to the floor, and the body pipe inlet being configured to allow at least a portion of the piston pipe including the piston pipe outlet to pass therethrough to be slidably received in the body pipe passageway and selectively positioned within the body pipe passageway such that water draining from the piston pipe outlet enters the body pipe passageway and drains out of the body pipe through the body pipe outlet;

a first seal retaining groove on an exterior surface of the piston pipe for retaining a seal configured to form a watertight seal between the piston pipe and the body pipe when the piston pipe is received in the body pipe passageway; and a second seal retaining groove on the exterior surface of the piston pipe between the first seal retaining groove and the piston pipe inlet for retaining the seal, or a second seal configured to form a watertight seal between the piston pipe and the body pipe when the piston pipe is shortened by removing a section thereof that includes the first seal retaining groove and excludes the second seal retaining groove.

2. The bathtub drain connector as claimed in claim 1, further comprising the seal retained in one of the first seal retaining groove and the second seal retaining groove.

3. The bathtub drain connector as claimed in claim 2, further comprising the second seal retained in the other of the first seal retaining groove and the second seal retaining groove.

4. The bathtub drain connector as claimed in claim 1, wherein one or both of the seal and the second seal are O-rings.

5. The bathtub drain connector as claimed in claim 1, wherein the first and second seal retaining grooves are positioned between 5.5 centimetres and 7.5 centimetres apart.

6. The bathtub drain connector as claimed in claim 1, wherein the bathtub drain comprises threading, and the bathtub drain engagement feature comprises threading on an interior surface of the piston pipe inlet for engaging the bathtub drain threading.

7. The bathtub drain connector as claimed in claim 1, wherein the bathtub drain engagement feature comprises threading on an interior surface of the piston pipe inlet, and an adaptor to be attached to the bathtub drain; and wherein the adaptor comprises adaptor threading for engaging the piston pipe threading.

8. The bathtub drain connector as claimed in claim 1, further comprising a cap including a body pipe engagement feature for attaching the cap to the body pipe inlet to prevent dust or debris from entering the piston pipe inlet and the body pipe inlet.

9. The bathtub drain connector as claimed in claim 8, wherein the cap further comprises a piston pipe engagement feature to simultaneously attach the cap to the body pipe to seal the piston pipe inlet and prevent air leakage from the piston pipe during a plumbing leakage pressure test of the bathtub drain connector when installed to the drain pipe.

10. The bathtub drain connector as claimed in claim 1, wherein the piston pipe comprises a plurality of reinforcing longitudinal ribs on the exterior surface of the piston pipe.

11. The bathtub drain connector as claimed in claim 1, wherein the piston pipe comprises a transverse line of weakness between the first seal retaining groove and the second seal retaining groove to facilitate the shortening of the piston pipe.

12. The bathtub drain connector as claimed in claim 1, wherein the transverse line of weakness is an area of reduced material requiring less effort by a user to saw or cut the piston pipe.

13. The bathtub drain connector as claimed in claim 12, wherein the transverse line of weakness is configured to form a beveled edge when sawed or cut by the user.

14. A method of connecting a bathtub drain to a drain pipe in a floor, the method comprising the steps of:

providing a body pipe having an inlet, an outlet, a passageway therebetween, and a flange for attaching the body pipe to the floor;

connecting the body pipe outlet to the drain pipe in the floor and attaching the flange to the floor;

providing a piston pipe having an inlet, an outlet, and a passageway therebetween, the piston pipe further comprising a first seal retaining groove on an exterior surface of the piston pipe for retaining a seal configured to form a watertight seal between the piston pipe and the body pipe when the piston pipe is received in the body pipe passageway, and a second seal retaining groove on the exterior surface of the piston pipe between the first seal retaining groove and the piston pipe inlet for retaining the seal, or a second seal configured to form a watertight seal between the piston pipe and the body pipe when the piston pipe is shortened by removing a section thereof that includes the first seal retaining groove and excludes the second seal retaining groove;

cutting the piston pipe between the first seal retaining groove and the second seal retaining groove to remove the section thereof that includes the first seal retaining groove;

mounting the seal, or the second seal in the second seal retaining groove of the shortened piston pipe;

inserting at least a portion of the shortened piston pipe including the second seal retaining groove through the body pipe inlet to be slidably received in the body pipe passageway;

selectively positioning the shortened piston pipe within the body pipe passageway to set the piston pipe inlet at a desired height above the floor; and connecting the bathtub drain to the piston pipe inlet to allow water from the bathtub drain to pass through the piston pipe and the body pipe into the drain pipe.

* * * * *